US009305737B2

(12) United States Patent
Hyde et al.

(10) Patent No.: US 9,305,737 B2
(45) Date of Patent: Apr. 5, 2016

(54) LIQUID FILAMENT FOR INCANDESCENT LIGHTS

(71) Applicant: Elwha LLC, Bellevue, WA (US)

(72) Inventors: Roderick A. Hyde, Redmond, WA (US); Jordin T. Kare, Seattle, WA (US); David B. Tuckerman, Lafayette, CA (US); Thomas A. Weaver, San Mateo, CA (US); Lowell L. Wood, Jr., Bellevue, WA (US); Richard N. Zare, Stanford, CA (US)

(73) Assignee: Elwha LLC, Bellevue, WA (US)

( * ) Notice: Subject to any disclaimer, the term of this patent is extended or adjusted under 35 U.S.C. 154(b) by 0 days.

(21) Appl. No.: 14/473,518

(22) Filed: Aug. 29, 2014

(65) Prior Publication Data

US 2016/0064205 A1 Mar. 3, 2016

(51) Int. Cl.

| | |
|---|---|
| ***H01J 1/06*** | (2006.01) |
| ***H01J 13/10*** | (2006.01) |
| ***H01J 1/05*** | (2006.01) |

(52) U.S. Cl.

CPC .. *H01J 13/10* (2013.01); *H01J 1/05* (2013.01)

(58) Field of Classification Search

CPC ..... H01J 1/04–1/10; H01J 13/00–13/58; H01J 2893/0077

USPC ..... 313/16, 29, 483, 150, 163–173, 232, 313/328

See application file for complete search history.

(56) References Cited

U.S. PATENT DOCUMENTS

| | | | | |
|---|---|---|---|---|
| 328,759 | A | 10/1885 | Chandler, Jr. | |
| 2,215,648 | A * | 9/1940 | Marden et al. | 313/27 |
| 3,405,328 | A | 10/1968 | Johansen et al. | |
| 5,148,080 | A | 9/1992 | Van Thyne | |
| 6,559,597 | B1 * | 5/2003 | Friedman | 313/578 |
| 7,190,117 | B2 | 3/2007 | Rosenbauer | |
| 7,250,723 | B1 * | 7/2007 | Foster | 313/582 |
| 2007/0228986 | A1 | 10/2007 | Sommerer et al. | |

* cited by examiner

*Primary Examiner* — Anne Hines
*Assistant Examiner* — Jose M Diaz
(74) *Attorney, Agent, or Firm* — Foley & Lardner LLP

(57) ABSTRACT

A filament for a light bulb includes a tube and a filament material within the tube, wherein the filament material is configured to be in a liquid state while the light bulb is in use.

33 Claims, 6 Drawing Sheets

LIQUID FILAMENT FOR INCANDESCENT LIGHTS

BACKGROUND

Lighting devices such as light bulbs or lamps provide light for use in residential, commercial, or other applications. The efficiency and power consumption of lighting devices is a concern to the purchasers, operators, and regulators of lighting devices. Traditional incandescent light bulbs may not provide light with a desired efficiency. In some cases, incandescent light bulbs fail to satisfy the efficiency requirements of government regulators. Lamps typically receive energy from a source and convert the energy into light. Multiple techniques may be used depending on the lamp to convert energy into light. Incandescent light bulbs heat a filament which gives off light following the principles of incandescence.

SUMMARY

One embodiment relates to a filament for a light bulb including a tube and a filament material within the tube. The filament material may be in a liquid state while the light bulb is in use.

Another embodiment relates to a light bulb including a tube and a filament material within the tube. The filament material may be in a liquid state when the light bulb is in use. The tube may have an inner diameter, a first outer diameter at the midpoint of the tube, and a second outer diameter at the ends of the tube. The second outer diameter may be larger than the first outer diameter.

Another embodiment relates to a filament for a light bulb including a tube and a filament material within the tube. The filament material may be in a liquid state when the light bulb is in use. The tube may include a cap at each end of the tube.

Another embodiment relates to an incandescent light including a tube, a filament material within the tube, a supply wire configured to provide energy to the filament material, a support wire configured to support the tube, a stem configured to support the support wire and partially house the supply wire, a base configured to be in electrical communication with a socket, and a bulb coupled to the base and configured to enclose the tube, supply wire, support wire, and stem. The filament material may enter into a liquid state while the light bulb is in use.

Another embodiment relates to an incandescent light including a tube, a filament material within the tube, a supply wire configured to provide energy to the filament material, a support wire configured to support the tube, a stem configured to support the support wire and partially house the supply wire, a base configured to be in electrical communication with a socket, and a bulb coupled to the base and configured to enclose the tube, supply wire, support wire, and stem. The filament material may be in a liquid state the light bulb is in use. The bulb may contain a gas such that the gas is in contact with the tube.

Another embodiment relates to an incandescent light including a tube configured to be transverse to the light bulb, a filament material within the tube, a supply wire configured to provide energy to the filament material, a support wire configured to support the tube, a stem configured to support the support wire and partially house the supply wire, a base configured to be in electrical communication with a socket, and a bulb coupled to the base and configured to enclose the tube, supply wire, support wire, and stem. The incandescent light may further include a control circuit coupled to the supply wire and configured to be in communication with a power source, and further configured to regulate the energy provided to the filament material. The control circuit may be configured to provide energy to the filament material such that the filament material is in a liquid state the light bulb is in use.

Another embodiment relates to a method for generating incandescent light using a filament material which melts when in use. The method includes providing energy to the filament material via a supply wire, melting the filament material, and containing the filament material within a tube.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
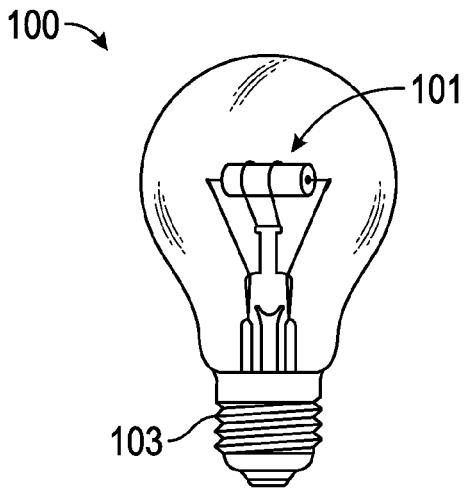
FIG. 1A illustrates an incandescent light having a liquid filament when in use and having a standard E26 size base according to one embodiment.

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Referring to the figures generally, various embodiments disclosed herein relate to an incandescent lighting system that utilizes a filament material which is heated beyond its melting point to produce a liquid filament. The liquid filament can be contained in a tube or capillary which has a melting point higher than that of the filament material. The incandescent lighting system may be configured to operate with one or more of a plurality of lamp sockets. The incandescent lighting system may be used to replace existing lamps or light bulbs not using the liquid filament system described herein. In some embodiments, the liquid filament system is operable with other components of a standard incandescent light bulb. A liquid filament system can be added to an existing incandescent light bulb as a retrofit.

The liquid filament system of the incandescent lighting system described herein may be more efficient than a traditional incandescent light bulb using a filament which remains in its solid state while in use. A tube or capillary can contain the filament material and thereby allow the filament material to be heated beyond its melting point. In some embodiments, this allows the incandescent lighting system to operate with the filament material heated to a higher temperature than traditional solid filament incandescent lights. As the temperature of the filament is higher in the incandescent lighting system using a liquid filament, the efficiency of the incandescent lighting system described herein may be greater than that of a traditional light bulb. The filament will luminesce exponentially more as the temperature of the filament is increased following the Stefan-Boltzmann law. Thus, a greater light producing efficiency may be achieved by heating the filament beyond its melting point.

Figure 1B:
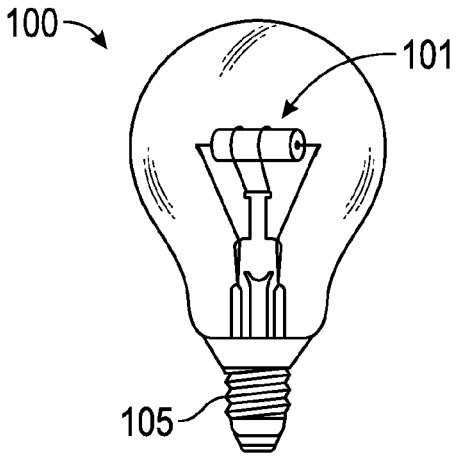
FIG. 1B illustrates an incandescent light having a liquid filament when in use and having an alternatively sized Edison screw base according to one embodiment.
Figure 1C:
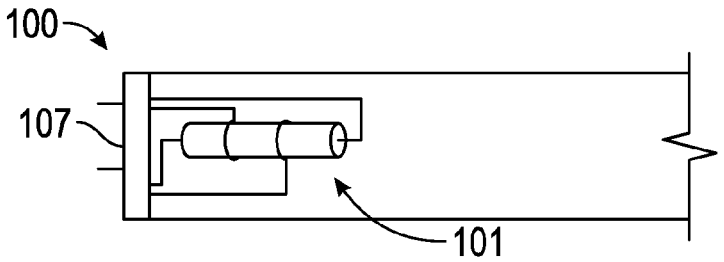
FIG. 1C illustrates an incandescent light having a liquid filament when in use and having a configuration for use with a fluorescent-lamp type socket according to one embodiment.

Referring to FIGS. 1A-1C, incandescent light 100 includes liquid filament system 101. As discussed in greater detail with reference to FIGS. 2A and 2B, liquid filament system 101 can include a plurality of components to facilitate the use of a filament material which is heated beyond its melting point when incandescent light 100 is in use. Incandescent light 100 may be configured to be compatible with one or more of a variety of lamp sockets. Incandescent light 100 may also be configured with its components in a variety of configurations, geometries, and/or shapes.

Referring now to FIG. 1A, in one embodiment incandescent light 100, including liquid filament system 101, includes standard medium size base 103. For example, standard medium size base 103 may be an E26, E27, or other standard sized base for use with a corresponding lamp socket. Medium size base 103 may make incandescent light 100 compatible with existing lamp sockets configured to accept traditional incandescent light bulbs (e.g., with solid filaments) having standard medium size base 103. In some embodiments, traditional incandescent light bulbs are replaceable with incandescent light 100 without the use of an adapter, tools, or other retrofitting components. An existing traditional incandescent light bulb may be unscrewed from a lamp socket and replaced with incandescent light 100 having standard medium size base 103.

Referring now to FIG. 1B, in another embodiment incandescent light 100, including liquid filament system 101, includes standard small size base 105 in some embodiments. For example, standard small size base 105 may be an E12, E14, or other standard sized base for use with a corresponding lamp socket. Small size base 105 may make incandescent light 100 compatible with existing lamp sockets configured to accept traditional incandescent light bulbs (e.g., with solid filaments) having standard small size base 103. In some embodiments, traditional incandescent light bulbs are replaceable with incandescent light 100 without the use of an adapter, tools, or other retrofitting components. An existing traditional incandescent light bulb may be unscrewed from a lamp socket and replaced with incandescent light 100 having standard small size base 105.

Referring now to FIG. 1C, in another embodiment incandescent light 100, including liquid filament system 101, includes pin style base 107. Pin style base 107 may allow incandescent light 100 to be used with a corresponding pin type lamp socket. For example, pin type lamp sockets may be lamp sockets for use with fluorescent lamps, neon lamps, flood lamps, arc lamps, and/or other lamps.

Incandescent light 100 may have a base other than those described above. The base of incandescent light 100 may be any base for use with any lamp socket. The above description is illustrative, and other base configurations may be used with incandescent light 100.

Figure 2A:
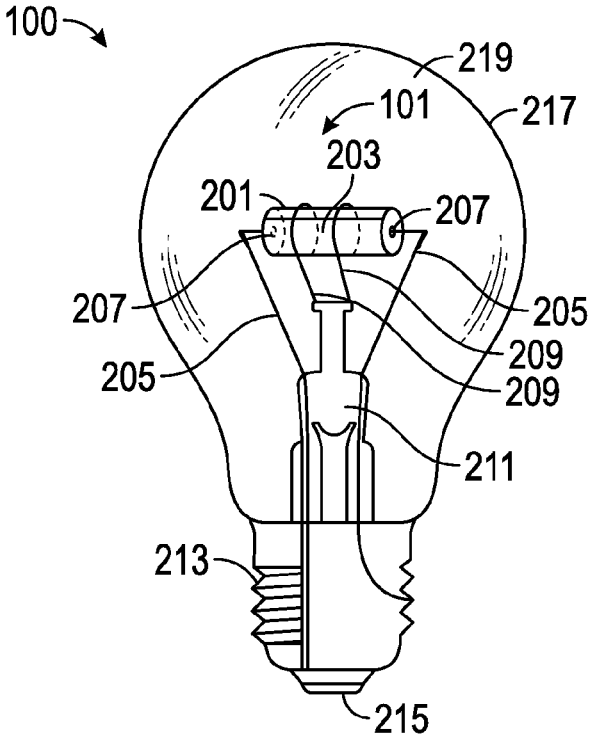
FIG. 2A illustrates an incandescent light having a solid filament material contained within a tube according to one embodiment.

Referring now to FIG. 2A, incandescent light 100 is illustrated according to one embodiment with filament material 203 in a solid state. Filament material 203 can be contained within tube 201. Tube 201 can be supported within incandescent light 100 by one or more support wires 209. Support wires 209 may be connected to stem 211. Stem 211 may include supply wires 205. In an unillustrated embodiment, stem 211 may be directly connected to tube 201. Supply wires 205 can provide electrical energy (e.g., via electrical current) to filament material 203 from an electrical source in contact with incandescent light 100. Supply wire 205 can have two portions, each connected to a different end of filament material 203 so as to deliver current to one end of filament material 203 and collect it from the other end. Supply wires 205 may be in electrical communication with the supply via base 213 and/or contact 215.

In one embodiment, filament material 203 is a metal, chosen to conduct electricity both in the solid state and in the liquid state. Filament material 203 may be chosen based on the boiling point of the metal. For example, filament material 203 may be chosen to maximize the boiling point of the filament. This may increase the efficiency of incandescent light as, when in liquid state, filament material 203 is contained within tube 201. While a liquid, filament material 203 continues to conduct electricity, be heated, and give off light due to incandescence. Heating filament material 203 to or beyond its boiling point may cause filament material 203 to stop conducting electricity, stop luminescing, damage other components of incandescent light 100, or otherwise cause undesirable effects. As such, filament material 203 may be chosen to maximize the boiling point and therefore provide greater efficiency at higher temperatures without the undesired effects associated with transitioning to a gas state (e.g., filament material 203 may be chosen based on its having a high boiling point). Filament material 203 may be heated to a temperature beyond its melting point but well below its boiling point. Filament material 203 may be selected based on mechanical properties which allow operation at a greater temperature. For example, filament material 203 may be selected based on properties such as vaporization pressure, boiling point, melting point, resistance, coefficient of thermal expansion, and/or other properties related to heating filament material 203 to a high temperature (e.g., a temperature at which incandescence may be more efficient). Filament material 203 may be selected based on its ability to wet the inner surface of tube 201, i.e., upon the surface energy between filament material 203 and the material tube 201 (or of a coating on the inner surface of the tube).

Filament material 203 can also or instead be chosen based on its incandescent properties and/or other light effecting properties. For example, filament material 203 can be chosen based on properties such as the theoretical maximum lumens per watt, how closely filament material 203 approximates a blackbody, emissivity, absorptivity, and/or other properties which affect or are related to the incandescence of filament material 203. Filament material 203 may be selected based on the desired light output. In further embodiments, filament material 203 is selected based on a combination of one or more of the considerations discussed herein and/or other engineering considerations.

In one embodiment, filament material 203 is tungsten (W). Filament material 203, when constructed of tungsten, may have a high boiling point. This allows filament material 203 to be heated beyond its melting point and up to its boiling point. By increasing the temperature of filament material 203 beyond its melting point, the efficiency of incandescent light 100 may be greater than that of other incandescent lights (e.g., incandescent lights having a solid tungsten filament). In other embodiments, filament material 203 is tungsten and is heated beyond its melting point but below the temperature at which vaporization begins to occur (e.g., filament material 203 is heated beyond its melting point but well below its boiling point). This may increase the useful life of filament material 203.

In other embodiments, filament material 203 is a metal other than tungsten. For example, filament material 203 may be or include one or more of hafnium, rhenium, aluminum, copper, iron, titanium, steel, or other metals. Filament material 203 may be an alloy or other combination of metals and/or other materials. Filament material 203 may be a solution containing a plurality of materials. The solution may include metallic, non-metallic, and/or other materials.

Still referring to FIG. 2A, supply wires 205 provide electricity to filament material 203. Supply wires 205 are in electrical communication with filament material 203. In some embodiments, supply wires 205 enter tube 201 through openings 207. Openings 207 can be configured to support supply wires 205. Openings 207 and/or tube 201 can be configured to insulate supply wires 205 from heat produced by filament material 203, reduce a stress on supply wires 205, and or otherwise protect supply wires 205. The protection provided by tube 201 and/or openings 207 is discussed in greater detail herein with respect to FIGS. 3A-3E.

In one embodiment, supply wires 205 enter stem 211 of incandescent light 100 and are mechanically and/or electrically coupled to base 213 and contact 215. Supply wires 205 can form a circuit with a source of electricity (e.g., a lamp socket).

Supply wires 205 are constructed of an electrically conductive material. The material of which supply wires 205 are constructed may be chosen based on its mechanical properties. For example, the material may be selected based on melting point, resistance, coefficient of thermal expansion, corrosion resistance, and/or other properties. The material may be selected in order to supply filament material 203 with electricity without being destroyed by the high temperature of filament material 203 (e.g., the operating temperature of filament material 203 while molten). In other words, in one embodiment the material of supply wires 205 is selected in order to continue to provide electricity to filament material 203 while filament material 203 is in a liquid state and/or at high temperatures. Supply wires 205 may be made of a material selected based on its ability to continue to supply electricity to a molten filament material 203 at a high temperature. In some embodiments, the geometry of supply wires 205 (e.g., diameter, length, shape, etc.) is selected such that supply wires 205 continue to provide electricity to filament material 203 while filament material 203 is at a high temperature (e.g., while filament material 203 is molten). In one embodiment, supply wires 205 are copper. In another embodiment, supply wires 205 are tungsten, rhenium, or hafnium. In still further embodiments, supply wires 205 are made of a conductive material which may include one or more metals, alloys, non-metals, and/or other materials.

As filament material 203 is provided with electricity by supply wires 205, filament material 203 increases in temperature. The resistive heating of filament material 203 causes the increase in temperature of filament material 203 in response to being provided with energy (e.g., electricity) by supply wires 205. The resistance of filament material 203 may increase as the temperature of filament material 203 increases.

In some embodiments, filament material 203 is contained within tube 201. Tube 201 may be configured to contain filament material 203 in solid and liquid states. In one embodiment, tube 201 is transparent to all or some of the radiation emitted by filament material 203. Light produced due to the incandescence of filament material 203 exits liquid filament system 101 through tube 201. This allows the light produced by filament material 203 to be observed beyond incandescent light 100 (e.g., bulb 217 is transparent or translucent). In other embodiments, tube 201 is translucent to all or some of the radiation emitted by filament material 203. In still further embodiments, tube 201 is opaque to all or some of the radiation emitted by filament material 203. In the case that tube 201 is opaque, energy (e.g., light and/or heat) radiated by filament material 203 may be absorbed by tube 201. The energy from filament material 203 absorbed by tube 201 causes tube 201 to incandesce and radiate visible light. In other embodiments, tube 201 is a selective absorber. Tube 201 may selectively absorb light of specific wavelengths. This may allow for light of non-absorbed wavelengths to pass through tube 201. The light of absorbed wavelengths may be absorbed by tube 201, and, in some embodiments, may be re-radiated by tube 201 at the same or other wavelengths.

In some embodiments, tube 201 is a capillary tube. The capillary tube may have a geometry such that capillary forces act on filament material 201. Tube 201 with a capillary tube geometry is described in more detail herein with reference to FIG. 3E.

Tube 201 may have a geometry configured to contain filament material 203 such that filament material 203 remains at an elevated temperature, produces a greater amount of light, and/or more closely approximates a black body. In one embodiment, the cross-section of tube 201 is cylindrically shaped. The cross-section of tube 201 may be shaped to maximize the surface area of filament material 203 contained within tube 201. The cross-section of tube 201 can be further shaped to minimize the absorption of light caused by tube 201. For example, tube 201 may be cylindrical with minimized wall thickness. Tube 201 may be shaped to prevent natural convection due to the heat of filament material 203. For example, tube 201 may have a small diameter. Tube 201 may be further configured to minimize filament cooling effects. For example, tube 201 may have a thickness which insulates filament material 203 from the cooling effects of fill gas 219 within bulb 217. The geometry of tube 201 may further be selected based on emission angle in order for liquid filament system 101 to more closely approximate a blackbody light source. The cross-sectional shape of tube 201 may be further configured to increase the blackbody effects of filament material 203 by increasing reflections of the emitted radiation within filament material 203. Tube 201 may be configured such that filament material 203 is maintained in a small volume such that filament material 203 may be approximated as a point source of light for easier prediction of performance of incandescent light 100. While some embodiments of tube 201 are illustrated as having a straight configuration, in some embodiments tube 201 can be curved either in a plane (e.g., forming a circular arc), or in 3-D (e.g., forming a helix or coil).

In further embodiments, the geometry of tube 201 is selected to reduce the stress on tube 201 and/or supply wires 205. Tube 201 may also be configured to reduce the temperature of supply wires 205. This is discussed in more detail with reference to FIGS. 3A-3E herein.

In some embodiments, tube 201 is supported within bulb 217 by support wires 209. The number of support wires 209 may be minimized by decreasing the weight of tube 201 and/or filament material 203 (e.g., by decreasing the amount of filament material 203, thickness of tube 201, etc.). In one embodiment, two support wires 209 are used to support tube 201. In other embodiments, more or fewer support wires 209 are used. In some embodiments, tube 201 is supported entirely by stem 211 and no support wires 209 are used. In some embodiments, tube 201 is supported entirely by supply wires 205 and no support wires 209 are used. Support wires 209 may be shaped to minimize the contact area with tube 201. This may decrease any cooling effect caused by conduction of heat from filament material 203 and/or tube 201 away by support wires 209. Similarly, the use of fewer support wires 209 may decrease cooling effects. Advantageously, this may allow filament material 203 to reach a higher temperature with less energy, thereby increasing the efficiency of the light produced. In some embodiments, support wires 209 attach to stem 211 in order to support tube 201. In other embodiments, support wires 209 attach to other locations of incandescent light 100.

Stem 211 is connected to base 213. Stem 211 may provide an attachment point for support wires 209 as described above. Stem 211 may further provide a passage for supply wires 205 to connect to base 213 and/or contact 215. Contact 215 and/or base 213 are electrically conducting such that a circuit is formed including the lamp socket in which incandescent light 100 is placed, supply wires 205, and filament material 203. Base 213 may be configured such that incandescent light 100 operates with one or more lamp sockets as previously described with reference to FIGS. 1A-1C.

In some embodiments, bulb 217 is attached to base 213. Bulb 217 may form a gas tight seal with base 213 and enclose liquid filament system 101 and/or other components (e.g., supply wires 205, a portion of stem 211, support wires 209, etc.). Bulb 217 may connect to base 213 and terminate at a tip opposite from base 213. Bulb 217 may be transparent or translucent. In some embodiments, bulb 217 is made of glass. The type of glass used in the construction of bulb 217 may affect the light produced by incandescent light 100. For example, the glass of bulb 217 may be neodymium-containing glass. In further embodiments, bulb 217 is coated or doped. The light emitted by incandescent light 100 may be altered by bulb 217 and/or a coating or dopant thereon. For example, light emitted by filament material 203 may be partially or completely absorbed by bulb 217 or a coating or dopant and re-emitted with different properties (e.g., a different wavelength than the light emitted by filament material 203). A coating or dopant may otherwise alter the light emitted by filament material 203. For example, bulb 217 may be coated with kaolin to diffuse light emitted by filament material 203.

In some embodiments, bulb 217 contains fill gas 219 within incandescent light 100. As explained in more detail with reference to FIG. 2B, fill gas 219 may reduce evaporative loss of tube 201 and/or of filament material 203 caused by the high temperature of filament material 203 and therefore the high temperature of tube 201. In other embodiments, bulb 217 may be evacuated such that bulb 217 contains a vacuum. Liquid filament system 101 may be within the vacuum. Advantageously, positioning liquid filament system 101 within a vacuum may reduce cooling effects caused by conduction and/or convection of heat from tube 201 to a gas within bulb 217. Any gas within bulb 217 is partially or completely evacuated and replaced by a partial or complete vacuum.

Still referring to FIG. 2A, filament material 203 may incandesce in response to energy from supply wires 205 while filament material 203 is in a solid state. For example, a switch may be operated which causes filament material 203 to be supplied by electricity via a lamp socket, contact 215, base 213, and supply wires 205. As electricity is supplied to filament material 203, filament material 203 increases in temperature. As the temperature of filament material 203 increases, filament material 203 incandesces and gives off light in the visible spectrum. In one embodiment, filament material 203 gives off light in the visible spectrum while below its melting point.

Figure 2B:
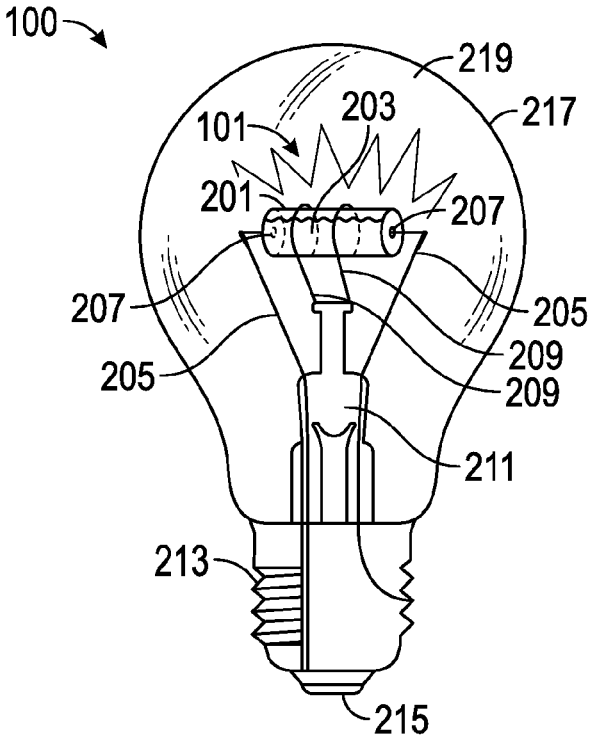
FIG. 2B illustrates an incandescent light having a liquid filament material contained within a tube according to one embodiment.

Referring now to FIG. 2B, incandescent light 100 is illustrated according to one embodiment with a liquid filament. Filament material 203 may be supplied energy (e.g., electricity) from supply wires 205 until the temperature of filament material 203 exceeds the melting point of filament material 203. Filament material 203 continues to produce visible light after having transitioned from a solid state to a liquid state. In other embodiments, filament material 203 is molten (e.g., in a liquid state) throughout all or a portion of the time during which incandescent light 100 is operating (e.g., turned on and/or providing light via incandescence). As electricity is provided to filament material 203, the resistance of filament material 203 may cause the temperature of filament material 203 to increase. The increase in temperature of filament material 203 may cause an increase in the resistance of filament material 203. Filament material 203 may be heated beyond its melting point through the continuing supply of electricity via supply wires 205. The liquid state filament material 203 is contained within tube 201.

Filament material 203 may produce or give off light during one or more of the stages described above. Filament material 203 produces light (e.g., incandesces) as a result of its increase in temperature. At greater temperatures, filament material 203 may be more efficient, thereby giving off more light per unit of energy supplied to filament material 203, than filament material 203 at a lower temperature. Advantageously, this may cause incandescent light 100 to produce light more efficiently. At higher temperature, filament material 203 may provide light in the visible spectrum more efficiently because as the temperature of filament 203 increases, the peak of the spectrum of light given off by filament material 203 shifts towards the visible light spectrum (e.g., more of black body radiation from filament material 203 falls in the visible part of the spectrum and less is in infrared wavelengths). In some embodiments, filament material 203 is heated to approximately 4000 kelvin (K).

Molten filament material 203 is contained within tube 201 in some embodiments. In other embodiments, molten filament material 203 is contained within a capillary tube (e.g., tube 201 is or includes a capillary tube as described herein). Tube 201 contains filament material 203 such that it does not lose electrical contact with supply wires 205 while molten. For example, tube 201 may have openings 207 and a volume such that filament material 203, while in liquid state, remains in contact with both supply wires 205 entering tube 201 through openings 207. Filament material 203, while a liquid, may remain in contact with supply wires 205 irrespective of the orientation of incandescent light 100. For example, the volume of tube 201 may be equal to the volume of filament material 203. In other embodiments, the volume of tube 201 is larger than the volume of filament material 203 to account for effects such as thermal expansion and volume change due to change in state (e.g., solid to liquid, liquid to solid). In some embodiments, the volume of tube 201 is larger than the volume of filament material 203, and liquid filament material 203 wets the inner surface of tube 201, occupying a volume along the inner surface of tube 201. In some embodiments the inner surface of tube 201 contains a microstructure to serve as nucleation sites when the liquid filament material 203 cools and resolidifies (e.g., in response to the light being turned off). In an embodiment the microstructure extends between the ends of tube 201, thereby insuring that a continuous conductive path of solid filament material 203 will exist in order to provide a current path when the light is turned on again. In some embodiments, the microstructure may comprise multiple pits or hills in the inner surface of tube 201. In some embodiments, the microstructure comprises a ridge or groove in the inner surface of tube 201.

Tube 201 may be configured with a volume the same as or similar to (e.g., on the same order of magnitude) that of filaments in traditional incandescent lamps (e.g., solid coiled-coil filaments). The volume of liquid filament system 100 may be maintained close to that of a traditional solid filament as tube 201 is made of a material capable of containing filament material 203 while molten (e.g., as opposed to a system requiring additional components and/or moving parts in order to contain a liquid filament). Advantageously, this allows filament material 203 to be contained within a small volume such that the outside diameter of bulb 217 may be the same as or similar to (e.g., on the same order of magnitude) that of traditional incandescent lamps. Incandescent light 100 may therefore be a more efficient, due to the increased temperatures of filament material 203, replacement for existing traditional incandescent lamps.

In one embodiment, tube 201 is or includes a refractory material. The material may be sufficiently refractory to contain molten filament material 203. The melting point of the material included in tube 201 may be higher than the temperature of filament material 203 while in a molten state. In other words, tube 201 may be constructed from a refractory material which has a melting point higher than the operating temperature of filament material 203 (e.g., the maximum temperature filament material 203 reaches while incandescent light 100 is producing light). In one embodiment, tube 201 does not conduct electricity.

In some embodiments, tube 201 is constructed of a material which conducts electricity from supply wires 205. Tube 201 may further provide electricity to filament material 203 contained within tube 201. In some embodiments, tube 201 incandesces as a result of conducting electricity from supply wires 205. The incandescent light produced by tube 201 may be combined with that of filament material 203 to function as a source of light for incandescent light 100. Incandescent light may be produced in response to tube 201 being heated by electricity from supply wires 205.

The material or materials of which tube 201 is constructed may be selected based on a variety of criteria. In some embodiments, the material or materials are selected based on mechanical properties. For example, the material or materials may be selected based on melting point, coefficient of thermal expansion, thermal shock resistance, strength, toughness, wettability with filament material 203, and/or other properties. In further embodiments, the material or materials are selected based on properties related to electromagnetic radiation. For example, the material or materials may be selected based on absorptivity, reflectivity, transmittance, approximation of a black body radiator, and/or other properties related to electromagnetic radiation.

In one embodiment, tube 201 is made of a material including hafnium (Hf). For example, tube 201 may be made of or include in its material makeup hafnium carbide (HfC), hafnium nitride (HfN), and/or other refractory materials. Advantageously, the material makeup of tube 201 may allow tube 201 to be transparent or translucent, and allow light from filament material 203 to exit tube 201. Simultaneously, tube 201 may be sufficiently refractory to contain filament material 203 while heated to a liquid state, thus increasing the efficiency of light produced by incandescent light 100. In one embodiment, tube 201 is made of tantalum 4 hafnium carbide 5 ($Ta_4HfC_5$) (e.g., approximately an 80/20 mix between tantalum carbide and hafnium carbide, or in other words, tantalum carbide doped with 20% hafnium). In embodiments where tube 201 is opaque and/or translucent, tube 201 may incandesce in response to the heat generated by filament material 203.

In some embodiments, fill gas 219 is contained within bulb 217. Fill gas 219 may be a gas which replaces evaporative losses (e.g., due to the high temperatures caused by filament material 203) from tube 201. In one embodiment, tube 201 includes HfN and fill gas 219 is nitrogen gas ($N_2$). Advantageously, evaporative loss of nitrogen (N) from tube 201 (HfN) can be replaced by N from fill gas 219. This may extend the life of tube 201. N evaporative loss from tube 201 can be stabilized with the use of nitrogen fill gas 219 in the lamp envelope (e.g., contained by bulb 217). In other embodiments, fill gas 219 is nitrogen donor gas rather than pure nitrogen gas.

In other embodiments, fill gas 219 is one or more other gasses configured to replace and/or maintain an evaporable component in one or more ceramics, or other materials, included in tube 201 or in filament material 203. For example, tube 201 may be a carbide rather than a nitrate, and fill gas 219 may be a gas which donates carbon and/or another material to tube 201 to combat evaporative loss. An equilibrium between tube 201 and fill gas 219 may be created which balances evaporative loss from tube 201 and diffusion from fill gas 219 to tube 201. In some embodiments, the ends or sides of tube 201 can contain openings to allow fill gas 219 access inside the tube, therefore allowing it to replace and/or maintain an evaporable component in filament material 203 and/or material of the inner surface of the tube. In still further embodiments, bulb 217 may maintain a vacuum encompassing tube 201. This may reduce heat loss (e.g., caused by natural convection and/or conduction) in cases where bulb 217 includes one or more gasses.

In other embodiments, bulb 217 contains one or more liquids. The liquid(s) can perform the same functions as fill gas 219. For example, the liquid can include one or more materials which prevent or reduce evaporative loss from tube 201. In further embodiments, the liquid can be used to affect the properties of the light emitted by tube 201 and ultimately emitted by incandescent light 100. For example, the liquid can diffuse the light emitted from tube 201, absorb specific wavelengths of light emitted from tube 201, emit light in response to absorbing light, filter light emitted from tube 201, and/or perform other functions which alter one or more characteristics of the light produced by tube 201 and/or filament material 203. The liquid may also be used to cool tube 201 and/or filament material 203. For example, filament material 203 can be cooled by the liquid such that filament material 203 is in a liquid state but does not enter a gas state due to increasing temperatures.

In one embodiment, incandescent light 100 is designed to have emissivity (e.g., from filament material 203, tube 201, a coating or dopant, and/or bulb 217) high in the visible wavelengths and low in the ultraviolet and/or infrared wavelengths. Advantageously, this may increase the efficiency of incandescent light 100 at producing light in the visible light spectrum. The emissivity of incandescent light 100 can be tailored based on the materials selected for components described herein, the geometry of materials described herein, and/or other factors described herein. For example, filament material 203 may be selected based on its properties in order to emit electromagnetic radiation in the visible spectrum. The temperature of filament material 203 may be increased (e.g., beyond the melting point of filament material 203) such that filament material 203 emits light mostly in the visible spectrum with decreased emission of light in the ultraviolet and/or infrared spectrum. The temperature of filament material 203 may be determined and/or regulated by the geometry of components of incandescent light 100 (e.g., filament material 203, tube 201, etc.) and/or by electronic components as described herein with reference to FIGS. 4A-5B. In further embodiments, other design parameters associated with incandescent light 100 may be altered in order to tailor the emissivity of incandescent light 100 (e.g., such that the light emitted by incandescent light 100 is mostly within the visible light spectrum). For example, fill gas 219, bulb 217, a coating on bulb 217, and/or other design considerations/parameters may be adjusted.

Referring now to FIGS. 3A-3E, the geometry of tube 201 may be configured to reduce stress on tube 201, reduce stress on supply wires 205, insulate supply wires 205, increase luminescent light output of filament material 203, reduce absorption of light from filament material 203, and/or otherwise facilitate the functions of the liquid filament system 101 and/or incandescent light 100 described herein.

Liquid filament system 100 may include tube 201 which has thicker ends and/or smaller diameter. This may reduce the stress at the ends of tube 201, e.g., by increasing the thickness-to-diameter ratio. The stress experienced by tube 201 may inherently (i.e., without the above-mentioned geometry changes) be higher at the ends of tube 201. Sources of stress may include stress due to the temperature of filament material 203 such as thermal expansion of tube 201, thermal shock, stress due to containing filament material 203 which may expand due to increased temperature, stress due to openings 207, stress due to the joint between the ends of tube 201 to the main section of tube 201 (e.g., tube 201 may be capped after tube 201 is filled with filament material 201), and/or other sources. Increasing the thickness of the ends of tube 201 may reduce stress from these and/or other sources. Advantageously, reducing the stress of tube 201 by increasing the thickness and/or lowering the diameter of the ends of tube 201 may increase the life of liquid filament system 101 and therefore incandescent light 100.

Figure 3B:
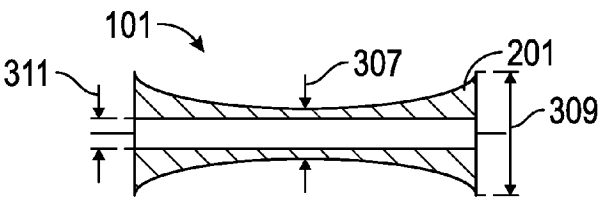
FIG. 3B, illustrates a tube with thicker ends and a continuously increasing outer diameter according to one embodiment.
Figure 3D:
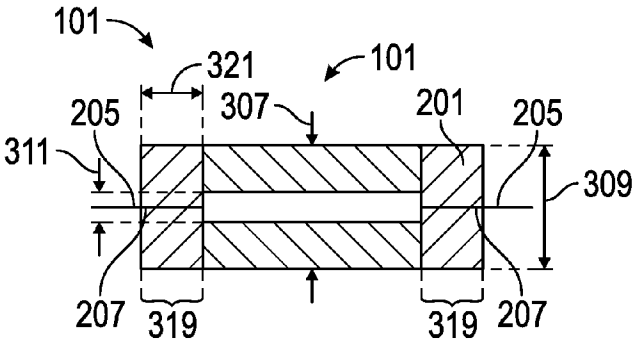
FIG. 3D illustrates a tube with constant outer diameter and with caps according to one embodiment.
Figure 3A:
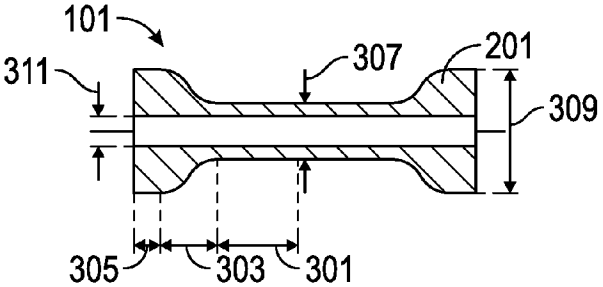
FIG. 3A illustrates a tube with thicker ends and a discontinuous outer diameter according to one embodiment.

Referring now to FIG. 3A, one embodiment of tube 201 is illustrated with thicker ends. Tube 201 has first outer diameter 307 at the midpoint of tube 201. First outer diameter 307 continues outward from the midpoint of tube 201 for first distance 301. For second distance 303, the outer diameter of tube 201 increases from first outer diameter 307 to second outer diameter 309. For third distance 305, the outer diameter of tube 201 is second outer diameter 309. Inner diameter 311 of tube 201 may be fixed throughout the length of tube 201. In other embodiments, inner diameter 311 varies along the length of tube 201 (e.g., decreasing at the ends of tube 201). The ends of tube 201 may be sealed except for openings 207 for supply wires 205. This configuration of tube 201 may reduce the stress at the ends of tube 201 while reducing the amount of material (e.g., the thickness of tube 201) at the midpoint. Advantageously, this may reduce the amount of light produced from filament material 203 which is absorbed by tube 201.

Tube 201 may be configured with first outer diameter 307, second outer diameter 309, inner diameter 311, and/or other features such that the temperature of tube 201 is lower at the ends of the tube 201. For example, the increased thickness of tube 201 may conduct more heat away from filament material 203, insulate tube 201 from heat from filament material 203, and/or otherwise lower the temperature of the ends of tube 201. For example, the outer surface of tube 201 can be microstructured to increase blackbody radiation near the ends of the tube, thereby reducing its temperature. The microstructure can have a size scale comparable to the wavelengths near the peak of the blackbody spectrum at the tube temperature, so as to enhance blackbody radiation. Advantageously, this may allow supply wires 205 to remain in a solid state while filament material 203 is in a liquid state. Additionally, the lower temperature at the ends of tube 201 may reduce the stress experienced by tube 201. First outer diameter 307 of tube 201 and second outer diameter 309 of tube 201 may be configured such that the stress of tube 201 is lower at the ends of the tube (e.g., the additional material may reduce the stress).

Referring now to FIG. 3B, an additional embodiment of tube 201 is illustrated. Inner diameter 311 is fixed throughout the length of tube 201. Tube 201 include first outer diameter 307 at the midpoint of tube 201. The outer diameter of tube 201 increases along the length of tube 201 toward the ends of tube 201 where the outer diameter is equal to second outer diameter 309. Tube 201 may have one or more of the advantages (e.g., reduced stress, temperature, etc. at the ends of tube 201) as described above with reference to FIG. 3A.

Figure 3E:
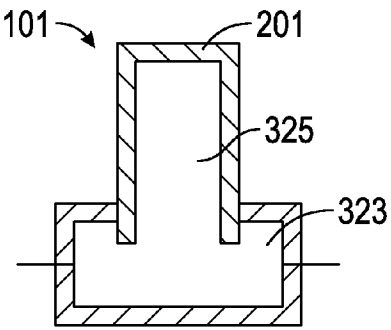
FIG. 3E illustrates a capillary tube according to one embodiment.
Figure 3C:
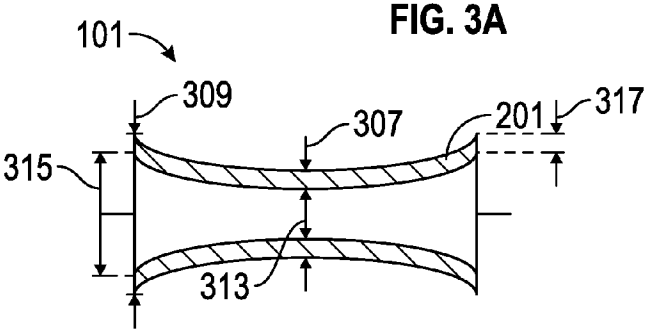
FIG. 3C illustrates a tube with thicker ends, a continuously increasing outer diameter, and an increasing inner diameter according to one embodiment.

Referring now to FIG. 3C, an additional embodiment of tube 201 is illustrated. Tube 201 includes first outer diameter 307 at the midpoint of tube 201. The outer diameter of tube 201 increases continuously along the length of tube 201 from the midpoint to the ends of tube 201. At the end of tube 201, tube 201 includes second outer diameter 309. At the midpoint, tube 201 includes first inner diameter 313. The inner diameter increases from the midpoint to the ends of tube 201 to second inner diameter 315. Tube wall thickness 317 may be constant along the length of tube 201. In some cases the cooling due to extra emissive surface area at the ends of such a tube may be more significant than potential increases in stress due to an increased diameter-to-thickness ratio. In other embodiments, tube wall thickness 317 increases or decreases. Tube 201 may have one or more of the advantages (e.g., reduced stress, temperature, etc. at the ends of tube 201) as described above with reference to FIG. 3A.

Referring now to FIG. 3D, an additional embodiment of tube 201 is illustrated having caps 319. Tube 201 includes first outer diameter 307 at the midpoint of tube 201. Tube 201 has an outer diameter fixed at the value of first outer diameter 307 along the length of tube 201. Tube 201 includes inner diameter 311 at the midpoint of tube 201 and continuing along the length of tube 201 until caps 319. The portion of tube 201 not including caps 319 may have thinner tube walls. Advantageously, this may reduce the amount of light emitted by filament material 203 which is absorbed by tube 201. Caps 319 form the ends of tube 201. Caps 319 are thicker than the middle portion of tube 201 and thereby reduce the stress and/or temperature at the ends of tube 201. Caps 319 include openings 207 for supply wires 205. The thickness of caps 319 insulates supply wires 205 in openings 207 from the high temperatures of filament material 203 (e.g., while in liquid state) contained within tube 201. This may allow all or the majority of supply wires 205 to remain solid and/or otherwise facilitate the delivery of electrical power to filament material 203 via supply wires 205. Caps 319 may have a thickness and/or otherwise be shaped to reduce the stress of tube 201 at the ends of the tube 201, reduce the temperature of tube 201 at the ends of tube 201, and/or reduce the temperature of supply wire 205.

Referring now to FIG. 3E, an embodiment of tube 201 is illustrated where tube 201 is a capillary tube. Tube 201 operates as and/or is a capillary tube. Tube 201 facilitates capillary action by filament material 203 while in liquid state. Tube 201 includes reservoir 323 which contains filament material 203. Tube 201 also includes capillary tube 325 which extends into reservoir 323. While in liquid state, filament material 203 may travel by capillary action up capillary tube 325. In some embodiments the wetting and capillary travel may insure that filament material 203 has a conductive path between the ends of the tube. Tube 201 may have other shapes, orientations, components, and/or configurations which allow for capillary action of filament material 203 while in a liquid state.

Referring generally to FIGS. 3A-3E, tube 201 includes openings 207 for supply wires 205. The configuration of tube 201 insulates or otherwise reduces the temperature and/or stress experienced by supply wires 205. In some embodiments, the shape of tube 201 facilitates and/or maintains an electrical connection between supply wires 205 and filament material 203. In further embodiments, the shape of tube 201 also facilitates the mechanical connection between tube 201 and/or openings 207 and supply wires 205 (e.g., by insulating supply wires 205 thereby maintaining the mechanical rigidity of supply wires 205).

Still referring generally to FIGS. 3A-3E, the illustrated embodiments are illustrative only. Further embodiments of tube 201 may be used to contain filament material 203. Furthermore, additional embodiments of tube 201 may be used to decrease the stress and/or temperature at the ends of tube 201 and/or supply wires 205. Tube 201 may have a combination of the features described above with reference to FIGS. 3A-3E. For example, tube 201 may have ends with an increased diameter as illustrated in FIG. 3A and may also have caps 319 as illustrated in FIG. 3D.

In some embodiments, tube 201 functions as a heat pipe. Advantageously, tube 201, acting as a heat pipe, provides substantially uniform black-body emission over an area. Filament material 203 can be in a liquid state as heated by energy from supply wires 205. Filament material 203 can be further heated into a gas state. The gas state filament material travels along the heat pipe formed by tube 201 and condenses into a liquid. This releases latent heat. Filament material 203 can be moved back into contact with supply wires 205 and/or another heat source (e.g., a reservoir of liquid filament material 203) by one or more of capillary action, centrifugal force, gravity, or other mechanism. The cycle repeats.

Figure 4A:
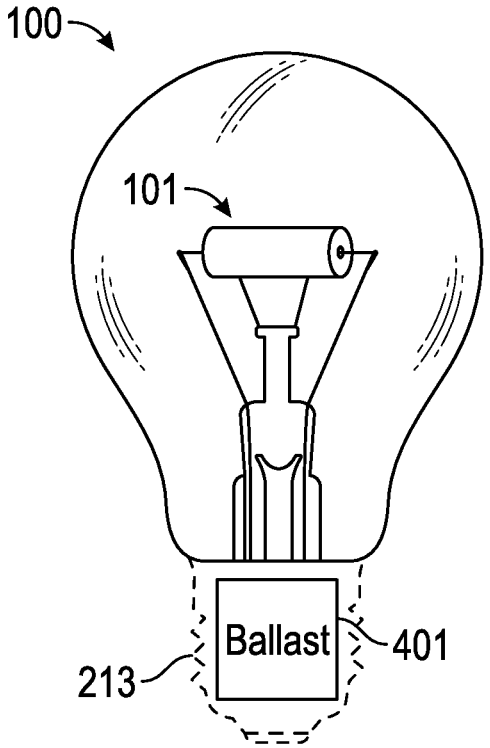
FIG. 4A illustrates an incandescent light having a liquid filament system and ballast according to one embodiment.
Figure 5A:
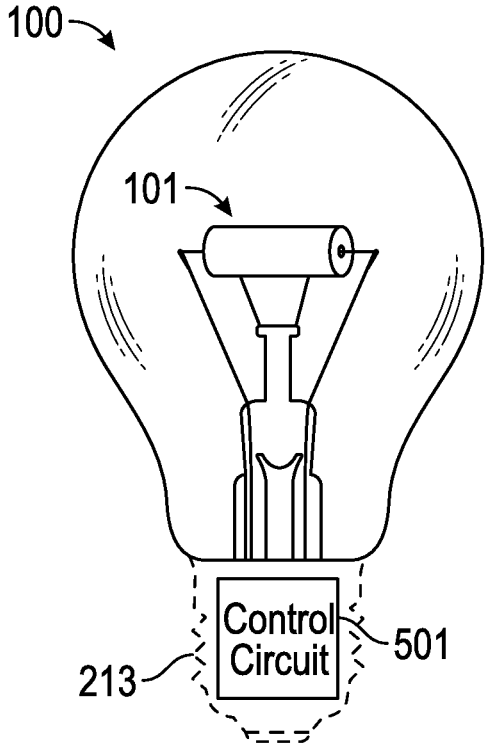
FIG. 5A illustrates an incandescent light having a liquid filament system and control circuit according to one embodiment.

Referring now to FIGS. 4A and 5A, incandescent light 100 includes circuitry and/or other components (e.g., ballast 401 or control circuit 501) in some embodiments. Ballast 401 and/or control circuit 501 are used to control incandescent light 100. In one embodiment, ballast 401 and/or control circuit 501 control the supply of electricity to filament material 203. This may allow ballast 401 and/or control circuit 501 to control the temperature of filament material 203. For example, electricity may be provided to filament material 203 until filament material 203 reaches a desired temperature. Electricity may then not be provided or provided with a lesser voltage and/or current in order to maintain the temperature of filament material 203. Ballast 401 and/or control circuit 501 may also be designed to control or provide for a designed emissivity of filament material 203. For example, by controlling the temperature of filament material 203, ballast 401 and/or control circuit 501 can control the wavelength (e.g., electromagnetic spectrum or portion of the electromagnetic spectrum) at which the peak of light emission for filament material 203 occurs. Ballast 401 and/or control circuit 501 may otherwise control the amount of current delivered to filament material 203. For example, ballast 401 and/or control circuit 501 may limit the amount of current supplied to filament material 203 such that filament material 203 does not reach the temperature at which filament material 203 boils or excessively evaporates.

Figure 4B:
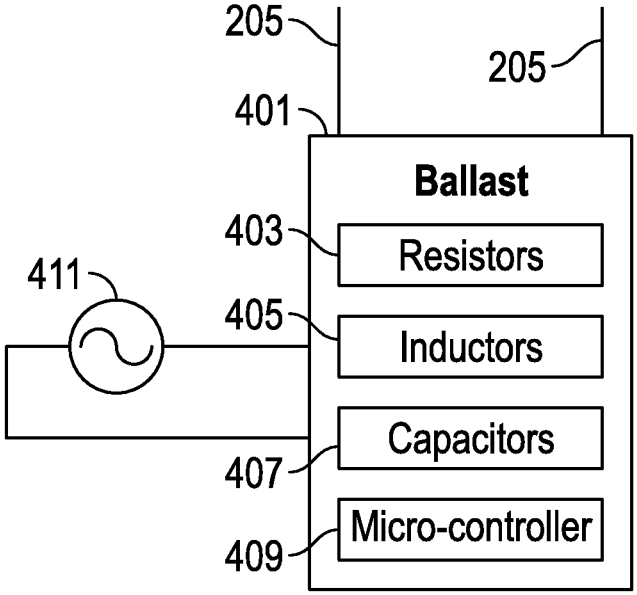
FIG. 4B illustrates the components of ballast according to one embodiment.

Referring now to FIG. 4B, components of ballast 401 are illustrated according to one embodiment. Ballast 401 may be in electrical communication with electrical source 411. Electrical source 411 may be a current source such as a lamp socket. Electrical source 411 may provide direct or alternating current. In some embodiments, ballast 401 is configured to transform alternating current into direct current. Ballast 401 may include elements such as resistors 403, inductors, 405, capacitors 407 and/or other electrical components (e.g., transformers, voltage regulators, etc.). These and/or other elements may be used to control the current provided to filament material 203 via supply wires 205 and/or perform the other functions of ballast 401 described herein. In some embodiments, ballast 401 includes one or more microcontrollers 409. Microcontroller 409 may be used to facilitate and/or carry out the functions of ballast 401 described herein. Microcontroller 409 may control one or more other elements of ballast 401.

In one embodiment, microcontroller 409 includes a control circuit. The control circuit may contain circuitry, hardware, and/or software for facilitating and/or performing the functions described herein. The control circuit may handle inputs, process inputs, run programs, handle instructions, route information, control memory, control a processor, process data, generate outputs, communicate with other devices or hardware, and/or otherwise perform general or specific computing tasks. In some embodiments, the control circuit includes a processor.

Microcontroller 409 may include a processor and/or memory. The memory may be communicably connected to the processor and provide computer code or instructions to the processor for executing the processes described herein. Memory and/or the control circuit may facilitate the functions described herein using one or more programming techniques, data manipulation techniques, and/or processing techniques such as using algorithms, routines, lookup tables, arrays, searching, databases, comparisons, instructions, etc.

Figure 5B:
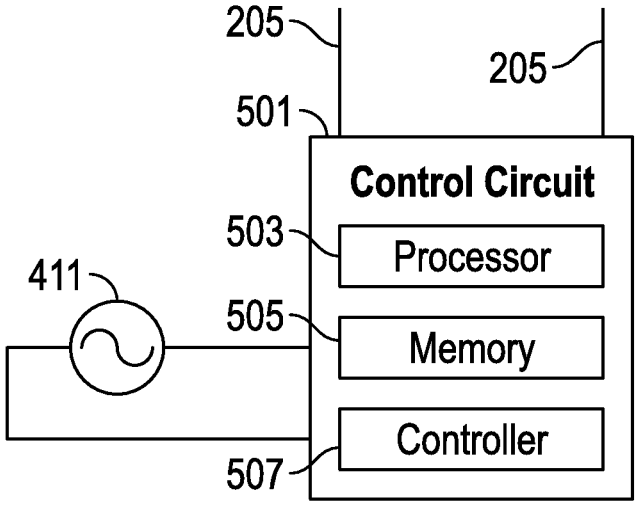
FIG. 5B illustrates the components of a control circuit according to one embodiment.

Referring now to FIG. 5B, components of control circuit 501 are illustrated according to one embodiment. Control circuit 501 contains circuitry, hardware, and/or software for facilitating and/or performing the functions described herein. Control circuit 501 handles inputs, processes inputs, runs programs, handles instructions, routes information, controls memory, controls a processor, processes data, generates outputs, communicates with other devices or hardware, and/or otherwise performs general or specific computing tasks. Control circuit 501 may be in electrical communication with source 411 (e.g., mains power through a lamp socket, a battery, etc.). In some embodiments, control circuit 501 includes processor 503, memory 505, controller 507, and/or other components (e.g., resistors 403, inductors 405, capacitors 407, etc.).

Processor 503 may be implemented as a general-purpose processor, an application specific integrated circuit (ASIC), one or more field programmable gate arrays (FPGAs), a digital-signal-processor (DSP), a group of processing components, or other suitable electronic processing components. Memory 505 is one or more devices (e.g. RAM, ROM, Flash Memory, hard disk storage, etc.) for storing data and/or computer code for facilitating the various processes described herein. Memory 505 may be or include non-transient volatile memory or non-volatile memory. Memory 505 may include database components, object code components, script components, or any other type of information structure for supporting various activities and information structures described herein. Memory 505 may be communicably connected to processor 503 and provide computer code or instructions to processor 503 for executing the processes described herein. Memory 505 and/or control circuit 501 may facilitate the functions described herein using one or more programming techniques, data manipulation techniques, and/or processing techniques such as using algorithms, routines, lookup tables, arrays, searching, databases, comparisons, instructions, etc.

Controller 507 may be controlled by processor 503. In response to instructions from processor 503, controller 507 may control additional electrical components such as those previously described. Controller 507 may perform the functions described herein such as altering the amount of current provided to supply wires 205 and therefore to filament material 203 in response to instructions from processor 503. Controller 507 may otherwise facilitate the performance of functions described herein with reference to control circuit 501.

Figure 6:
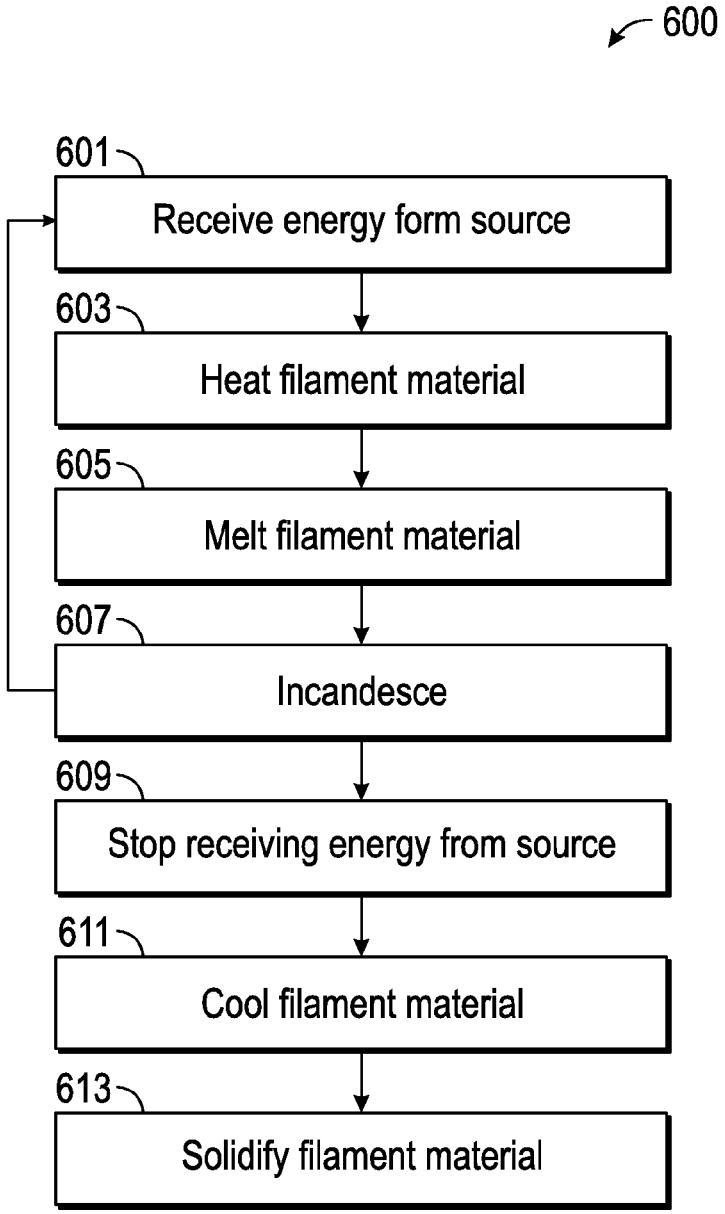
FIG. 6 illustrates a flow chart of a method of operating an incandescent light having a liquid filament system according to one embodiment.

Referring now to FIG. 6, a method 600 of operating incandescent light 100 is shown according to one embodiment. Incandescent light 100 may receive energy from an energy source (601). For example, incandescent light 100 may receive electrical energy from source 411 such as alternating current from a lamp socket. Incandescent light 100 may receive energy in response to a user turning on a light switch or otherwise completing a circuit including incandescent light 100 and a power source. Incandescent light 100 heats filament material 203 (603). Electrical energy may be provided to filament material 203 from source 411 via supply wires 205. In response to the electrical energy filament material 203 may increase in temperature (e.g., due to the resistance of filament material 203). Filament material 203 melts (605). Additional electrical energy may be provided to filament material 203 such that filament material 203 is heated beyond its melting point and filament material 203 enters a liquid phase. While in a liquid phase, filament material 203 may be contained within tube 201. Tube 201 and/or supply wires 205 may be configured to continue providing electrical energy to filament material 203 while filament material 203 is in a liquid state. Filament material 203 incandesces in response to the increase in temperature (607). In some embodiments, filament material 203 begins to incandesce while in a solid phase and continues to incandesce after melting (e.g., entering a liquid phase). Filament material 203 may continue to incandesce while it continues to receive energy (e.g., the light switch is on).

Filament material 203 stops receiving energy from the energy source (609). For example, a user may turn off a light switch or otherwise break a circuit including incandescent light 100. The above described portions of method 600 may repeat. For example, a user may later turn on a light switch causing incandescent light 100 and filament material 203 to receive energy. Once filament material 203 stops receiving energy, filament material 203 cools (611). Cooling of filament material 203 causes filament material 203 to solidify (613). Once filament material 203 cools to below its melting point, filament material 203 solidifies. Solidified filament material 203 is contained with tube 201. Tube 201 and/or supply wires 205 may be configured such that solidified filament 613 is still in contact with supply wires 205. This may enable supply wires 205 to provide electrical energy to solidified filament material 613 when a user turns on incandescent light 100 again.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

The invention claimed is:

1. A filament for a light bulb, comprising:

a tube; and a filament material within the tube, wherein the filament material is configured to be in a liquid state while the light bulb is in use;

wherein the tube is a capillary tube.

2. The filament of claim 1, wherein the filament material is electrically conductive while in the liquid state.

3. The filament of claim 1, wherein the liquid filament material wets an inner surface of the tube.

4. The filament of claim 1, wherein the liquid filament material is configured to spread across at least a portion of an inner surface of the tube via surface tension forces.

5. The filament of claim 1, wherein the filament material is configured to be a solid or solidify when not receiving energy from an energy source.

6. The filament of claim 1, wherein the filament material is configured to melt in response to energy received from an energy source.

7. The filament of claim 1, wherein the filament material is configured to incandesce.

8. The filament of claim 7, wherein the tube is transparent to at least a portion of the light produced by the filament material.

9. The filament of claim 1, wherein the tube is thicker at each end than at a location between the two ends.

10. The filament of claim 1, wherein a first outer surface of the tube and a second outer surface of the tube are configured such that the temperature of the tube is lower at each end of the tube than at a location between the two ends.

11. The filament of claim 1, wherein a first thickness and outer diameter of the tube and a second thickness and outer diameter of the tube are configured such that a stress of the tube is lower at each end of the tube than at a location between the two ends.

12. The filament of claim 1, wherein the tube includes a cap with a thickness configured to at least one of (a) reduce a stress of the tube at the ends of the tube, (b) reduce the temperature of the tube at the ends of the tube, or (c) reduce the temperature of a supply wire.

13. The filament of claim 1, wherein the tube has a higher melting point than the filament material.

14. The filament of claim 1, wherein the tube is a highly refractory material.

15. The filament of claim 1, wherein the tube includes at least one of hafnium carbide, hafnium nitride, or tantalum 4 hafnium carbide 5.

16. The filament of claim 1, wherein the filament material includes at least one of tungsten, hafnium, or rhenium.

17. The filament of claim 1, wherein the filament has a designed emissivity, and wherein the designed emissivity is relatively high in the visible wavelengths and relatively low in at least one of ultraviolet wavelengths and infrared wavelengths.

18. An incandescent light, comprising:

a tube;

a filament material within the tube;

a supply wire configured to provide energy to the filament material;

a base configured to be in electrical communication with a socket; and a bulb coupled to the base and configured to enclose the tube and supply wire, wherein the filament material is configured to enter into a liquid state while the light bulb is in use; and wherein the bulb contains an inert gas; wherein the opening for the supply wire is configured to allow gas transport between the bulb and an interior space of the tube.

19. The incandescent light of claim 18, wherein the tube includes an opening for the supply wire.

20. The incandescent light of claim 18, wherein a first outer surface of the tube and a second outer surface of the tube are configured such that the temperature of the tube is lower at each end of the tube than at a location between the two ends.

21. The incandescent light of claim 18, wherein a first thickness and outer diameter of the tube and a second thickness and outer diameter of the tube are configured such that a stress of the tube is lower at each end of the tube than at a location between the two ends.

22. The incandescent light of claim 18, wherein the filament material includes a metal.

23. The incandescent light of claim 22, wherein the filament material includes at least one of tungsten, hafnium, or rhenium.

24. The incandescent light of claim 18, wherein the bulb contains a gas configured to counteract evaporation of at least one of the tube and the filament material.

25. The incandescent light of claim 24, wherein the gas includes at least one of nitrogen gas, a nitrogen donating gas, or a carbon donating gas.

26. The incandescent light of claim 18, wherein the bulb holds a vacuum in which the tube is supported.

27. An incandescent light, comprising:

a tube;

a filament material within the tube;

a supply wire configured to provide energy to the filament material;

a base configured to be in electrical communication with a socket;

a bulb coupled to the base and configured to enclose the tube and supply wire; and a control circuit coupled to the supply wire and configured to be in communication with a power source, and further configured to regulate the energy provided to the filament material;

wherein the control circuit is configured to provide energy to the filament material such that the filament material is in a liquid state when the light bulb is in use.

28. The incandescent light of claim 27, wherein the control circuit is configured to regulate the energy to the filament material such that the filament material does not boil.

29. The incandescent light of claim 27, wherein a first outer surface of the tube and a second outer surface of the tube are configured such that the temperature of the tube is lower at each end of the tube than at a location between the two ends.

30. The incandescent light of claim 27, wherein a first thickness and outer diameter of the tube and a second thickness and outer diameter of the tube are configured such that a stress of the tube is lower at each end of the tube than at a location between the two ends.

31. The incandescent light of claim 27, wherein the tube includes a cap with a thickness configured to at least one of (a) reduce a stress of the tube at the ends of the tube, (b) reduce the temperature of the tube at the ends of the tube, or (c) reduce the temperature of a supply wire.

32. The incandescent light of claim 27, wherein the filament has a designed emissivity, and wherein the designed emissivity is relatively high in the visible wavelengths and relatively low in at least one of ultraviolet wavelengths and infrared wavelengths.

33. The incandescent light of claim 32, wherein the designed emissivity is controlled by the control circuit.

* * * * *